US007658213B1

(12) United States Patent
Anderson et al.

(10) Patent No.: US 7,658,213 B1
(45) Date of Patent: Feb. 9, 2010

(54) FLUID DISPENSING SYSTEM

(75) Inventors: Leif E. Anderson, Litchfield, MN (US); Wolfgang F. Schiller, Litchfield, MN (US); Danny L. Walker, Rockville, MN (US); Phillip A. Zuehl, Litchfield, MN (US); James H. Alsleben, Litchfield, MN (US); Robert Strom, Wayzata, MN (US); Michael K. Hogan, Green Bay, WI (US); Rodney Laible, Bennington, NE (US)

(73) Assignee: Anderson Chemical Company, Litchfield, MN (US)

( * ) Notice: Subject to any disclaimer, the term of this patent is extended or adjusted under 35 U.S.C. 154(b) by 0 days.

(21) Appl. No.: 11/405,741

(22) Filed: Apr. 18, 2006

Related U.S. Application Data

(63) Continuation of application No. 11/241,715, filed on Sep. 29, 2005, now abandoned.

(51) Int. Cl.
*B65B 1/04* (2006.01)

(52) U.S. Cl. ..... 141/286; 141/319; 141/352; 141/354

(58) Field of Classification Search ..... 141/330, 141/285, 286, 319, 329, 325, 351, 352, 356; 604/411, 414, 415; 222/85, 81, 481
See application file for complete search history.

(56) References Cited

U.S. PATENT DOCUMENTS

| | | | | |
|---|---|---|---|---|
| 488,473 | A | 12/1892 | Fruen | |
| 497,896 | A | 5/1893 | Ruppel | |
| 996,127 | A * | 6/1911 | Patnaude | 62/299 |
| 1,169,691 | A | 1/1916 | St. Elmo | |
| 1,241,352 | A | 9/1917 | Doering, Jr. et al. | |
| 1,246,879 | A | 11/1917 | Chadwick | |
| 2,401,674 | A * | 6/1946 | Vizay | 141/294 |
| 2,989,091 | A | 6/1961 | Lowenthal | |
| 3,174,519 | A | 3/1965 | Pizzurro et al. | |
| 3,343,724 | A | 9/1967 | Malpas | |
| 3,558,022 | A | 1/1971 | Zytko | |
| 4,060,184 | A | 11/1977 | O'Neil, Sr. | |
| 4,253,501 | A * | 3/1981 | Ogle | 141/27 |
| 4,281,779 | A * | 8/1981 | Shepard | 222/501 |
| 4,322,018 | A | 3/1982 | Rutter | |
| 4,574,985 | A | 3/1986 | Sykes | |
| 4,874,023 | A | 10/1989 | Ulm | |

(Continued)

*Primary Examiner*—Timothy L Maust
(74) *Attorney, Agent, or Firm*—Moss & Barnett

(57) ABSTRACT

A discharge valve for a bottle or other container associated with a fluid dispensing system that substantially prevents spillage of fluid composition from the container when it is withdrawn from the dispensing system is provided according to the invention. A valve body contained within the discharge valve is engaged by a hollow probe extending from the dispensing system when the container is operatively connected to the discharge system to automatically open the valve. When the container is withdrawn from the fluid dispensing system for, e.g., replacement or servicing, the probe of the dispensing system disengages the valve body, and a biasing means such as a compression spring within the valve assembly closes the valve very quickly. The valve body and valve seat of the valve assembly are designed in such a fashion that proper alignment and closure of the valve body with respect to the valve seat is achieved to provide a fluid-tight seal without use of a gasket or other elastomeric seal disposed between the valve body and valve seat to facilitate the fluid-tight seal.

25 Claims, 8 Drawing Sheets

U.S. PATENT DOCUMENTS 5,022,558 A 6/1991 Faerber et al.
5,031,675 A 7/1991 Lindgren
5,165,578 A 11/1992 Laible
5,280,764 A 1/1994 Levinrad
5,303,732 A 4/1994 Jonsson
5,325,995 A 7/1994 Harrison et al.
5,337,922 A 8/1994 Salkeld et al.
5,370,270 A * 12/1994 Adams et al. ..... 141/330
5,431,205 A * 7/1995 Gebhard ..... 141/351
5,465,833 A 11/1995 Tarter
5,653,270 A 8/1997 Burrows
5,694,991 A 12/1997 Harris et al.
5,722,635 A 3/1998 Earle
5,833,124 A 11/1998 Groves et al.
5,878,798 A 3/1999 Harris et al.
5,890,517 A 4/1999 Laible
5,988,456 A 11/1999 Laible
6,142,345 A 11/2000 Laible
6,325,115 B1 * 12/2001 Cowland et al. ..... 141/346
6,328,543 B1 12/2001 Benecke
6,539,985 B2 4/2003 Shinada et al.
6,607,102 B1 * 8/2003 Griese et al. ..... 222/173
6,669,062 B1 12/2003 Laible
6,675,845 B2 * 1/2004 Volpenheim et al. ..... 141/380
7,014,759 B2 * 3/2006 Radford ..... 210/232
7,086,431 B2 * 8/2006 D'Antonio et al. ..... 141/330

* cited by examiner

FLUID DISPENSING SYSTEM

CROSS-REFERENCE TO RELATED APPLICATION

This application is a continuation of U.S. application Ser. No. 11/241,715 filed on Sep. 29, 2005 now abandoned, which is hereby incorporated by reference.

FIELD OF THE INVENTION

This invention relates to a system for dispensing liquid products from a container in a controlled manner, and more specifically to such a system employing inverted containers in which a filled or partially filled container may be withdrawn from the system without spilling its contents.

BACKGROUND OF THE INVENTION

Liquid chemicals are indispensable components for the food processing, industrial, commercial, and institutional markets. Sanitary chemicals are used in manufacturing plants and institutional buildings to ensure safe and healthy environments. ° Detergents are essential for laundry facilities servicing the hospitality, hospital, college, and commercial laundry markets. Kitchens and dishes in restaurants and food service operations must be kept clean. Medicines must be dispensed to hospital patients in a precise manner. Water treatment programs are important for improving the quality of hard waters. Many food processing and other manufacturing operations admix chemicals in a precise manner.

Traditionally, many such chemicals have been mixed and dispensed manually. Moreover, many chemicals are produced and sold in concentrate form, meaning that they must be diluted by employees in order to reach their appropriate concentrations. Such mixing and dilution processes have often caused toxic spills and workplace contamination problems.

A further challenge is caused by the need to admix or dilute these chemicals within very precise dosage requirements. Addition of too much chemical causes waste and lost operating profits. However, too little chemical can prevent the desired chemical reaction for a manufacturing process from taking place.

Yet, many of these liquid chemicals and medical liquid products can be corrosive or otherwise dangerous if they are breathed or come into contact with skin. If spilled, they can damage equipment and property. Thus, liquid dispensing systems have been developed for safe handling and mixing of these chemicals.

The chemicals typically are packaged in a bottle, tote, drum, or other container, and are usually dispensed from the upright container to a mixing machine. A cap with a downwardly extending dip tube is placed on the container to draw the liquid from the bottle. A dispensing tube extends from the cap to a mixing machine or other piece of equipment, which creates the necessary suction to draw the liquid from the container interior. U.S. Pat. Nos. 5,988,456 and 6,142,345 issued to Laible disclose designs for a cap containing a valve that opens when the cap is screwed onto the container, and includes a separate umbrella valve for preventing backflow from the dispensing tube to the container and for permitting liquid flow from the container to the dispensing tube in response to suction applied to the dispensing tube.

U.S. Pat. No. 6,669,062 issued to Laible provides a dual outlet port cap for connection by means of dispensing tubes to two different mixing machines or other pieces of equipment.

The cap contains two thin, flexible valve seats that are pulled to their open position by means of the suction provided by a downstream mixing machine. The fluid dispensing device of U.S. Pat. No. 5,833,124 issued to Groves et al. constitutes a flexible bottle that is squeezed by hand to produce a positive pressure condition therein for forcing the liquid up through a dip tube to a measuring container. A manually adjustable outlet port positioned at the top of the dip tube in the measuring container permits a predetermined volume of the liquid to be transported from the storage bottle to the measuring container. Finally, U.S. Pat. No. 5,165,578 issued to Laible teaches a vented closure cap for a container that allows gases to vent into or out of the container to provide positive pressure for encouraging liquid in the container to leave through the dispensing tube, and to thwart any vacuum condition that might otherwise produce backflow.

It is popular, however, to operatively connect the container to the dispensing machine in an inverted position. Such inversion allows gravitational forces to draw the liquid out of the container, and eliminates the need for the mixing machine or other recipient device to produce the vacuum necessary to suck the liquid out of the container.

In such an inverted dispensing system application, the bottle containing the liquid usually includes an induction seal across the opening of the throat of the bottle, which is pierced by a sharp cutting edge of an upwardly extending probe located on the dispensing system. Once the seal is pierced, the liquid is free to flow by means of gravity from the container down into the dispensing system. U.S. Pat. No. 5,280,764 issued to Levinrad discloses a water bottle dispenser utilizing this simple principle. Other examples of this type of piercing spout are disclosed by U.S. Pat. Nos. 5,325,995 issued to Harrison et al., and 5,303,732 issued to Jonsson. U.S. Pat. No. 5,337,922 issued to Salkeld et al. teaches a water dispenser with a diaphragm positioned above a water feed tube. Once the water bottle is installed in an inverted position in engagement with the dispenser system, the diaphragm is pushed down so that the feed tube punctures it to enable water to pass through the hole. The purpose of this diaphragm, however, is to keep the end of the feed tube clean and sanitary when a water bottle is not installed on top of the dispensing system.

While this type of piercing spout provides a simple method for enabling water or another liquid to be released from a bottle, bag, or other container, there is nothing to control or stop the flow of the liquid once the container is punctured. Thus, it is known within the prior art to add a valve or other mechanical means to regulate the flow of the liquid from the end of the puncture spout. See, e.g., U.S. Pat. Nos. 1,169,691 issued to St. Elmo (pipe coupling for a water faucet); 3,343,724 issued to Malpas (tap for a flexible bag contained in a box); 4,322,018 issued to Rutter (fluid dispenser that pierces a sealable flexible plastic bag within a rigid outer box); 4,574,985 (dispensing valve for an ink bottle); and 5,022,558 issued to Faerber et al. (electromagnetically-operated valve within a beverage dispensing system).

A problem can arise, however, with such inverted bottles due to spillage. If the entire contents of the bottle is drained into the dispensing system before it is removed from the dispensing system, then no such spillage will occur. However, bottles associated with dispensing systems frequently need to be changed or serviced (e.g., a different chemical is needed), which entails uninstalling the bottle from the dispensing system. Because the bottle has been pierced and no other closure means is present, some of the liquid will drain out of the bottle while it is removed from the dispensing system and turned once again to its upright position. If the liquid is water which needs to be mopped up, such spillage is a nuisance. However, if the liquid is a corrosive or other hazardous chemical or medicinal product that should not be touched or breathed, then this spillage can pose a serious environmental or worker safety problem.

Efforts have therefore been made within the liquid dispensing industry to provide the bottle or other container with a sealing plug that can be readily pierced by a nozzle or spout associated with the dispensing system, but will close itself when the bottle and its plug are withdrawn from the nozzle or spout. See, e.g., U.S. Pat. Nos. 1,241,352 issued to Doering, Jr. et al. (water cooler), 3,558,022 issued to Zytko (medicine bottle and dropper); 4,060,184 issued to O'Neill, Sr. (butterfly valve for a container opened by a reciprocated rod); 5,031,675 issued to Lindgren (resealable stopper for an ink bottle installed to a printer); 5,465,833 issued to Tarter (slit valve in a bag engaged by a syringe); and 6,328,543 issued to Benecke (slit valve on a fluid container engaged by an upwardly extending probe on a gear pump).

These types of sealing plugs are usually made from rubber or another type of elastomeric material. The resiliency of this material is relied upon to return the plug from its pierced state to its sealed state once the plug is removed from the dispenser system nozzle or probe. In some cases, the pressure of the liquid contained within the container assists with the closure of the sealing plug. See, e.g., U.S. Pat. No. 1,241,352 issued to Doering, Jr. et al.

It is therefore necessary in some dispensing system applications to provide a more positive closure mechanism for an inverted bottle or container in order to ensure that the bottle outlet is sealed quickly and affirmatively after the bottle is withdrawn from the dispensing system. Thus, U.S. Pat. No. 5,653,270 issued to Burrows discloses a bottle cap and valve assembly for a bottled water station. The cap includes a "valve member" constituting a movable plate that is disposed within the throat of the bottle. A probe extending upwardly from the top of the water station pushes the plate further into the throat when the inverted bottle is installed onto the water station to open the valve. An annular groove near the end of the probe engages an inward lip on the plate to secure the plate to the end of the probe. The water contained within the bottle flows through apertures in the side wall of the hollow probe and down through the interior of the probe into the water station. When the bottle is uninstalled, the probe pulls the plate back into abutment with the cap to close the valve and disengages from the plate so that the bottle can be withdrawn. In this manner, the bottle cap valve is opened and closed by means of physical counter forces exerted by the probe in response to the installation or removal of the valve.

U.S. Pat. No. 1,246,879 issued to Chadwick shows a valve for a liquid dispensing system. The fluid is contained inside an upper compartment, and flows through an aperture into a bottom compartment whereupon it can be discharged through a drain tube. Disposed within the discharge aperture of the upper container is a spring-biased valve having a frustoconical head that engages a torus valve seat portion of the upper compartment. While the patent disclosure is unclear regarding what means is used to open this valve, it is believed that it is manually operated. The difference in the radial section shape of the valve seat and the portion of the valve that cooperates with it produces only line contact to assure a positive seating of the valve.

U.S. Pat. No. 5,722,635 issued to Earle teaches a valve coupling associated with a container holding photo processing chemicals. The valve constitutes a reciprocating hollow plunger with a flat plate that is biased by a spring against the lower valve housing. A rubber seal surrounding the plunger shaft prevents leakage. A separate probe is manually inserted into a channel in the lower portion of the valve housing to positively push the plate portion of the valve up to expose discharge ports within the plunger that allows the chemicals to flow out of the container. Upon removal of the manually inserted probe, the spring returns the valve to its closed position.

Dispensing systems are also known in the prior art containing spring-biased valves of one sort or another that are automatically opened by installing the bottle or container containing the liquid into engagement with the dispensing system. Thus, U.S. Pat. No. 3,174,519 issued to Pizzurro et al. discloses a cigarette lighter containing butane fuel. The valve contained within the housing of the lighter consists of a ball that is pushed by a spring against an O-ring positioned around the refueling inlet port. A separate refueler storing the butane gas includes a discharge nozzle. When the nozzle is inserted into the housing, it pushes the ball valve away from the O-ring, thereby creating an opening to permit the butane gas from the refueler to flow into the lighter. When the nozzle of the refueler is removed, the spring pushes the ball against the O-ring to close the valve once again. In this manner, the cigarette lighter can be refueled.

U.S. Pat. No. 488,473 issued to Fruen in 1892 provides a water cooler constituting an outer housing and a receptacle holding the water and ice for insertion into the housing. A hollow plug connected to a discharge valve extends into the lower portion of the housing and has a hole in its upper end. Meanwhile, a cap secured to a hollow bushing surrounding the discharge outlet of the receptacle contains a spring-biased valve plate that engages a valve seat along the perimeter of the hollow bushing. A rubber disk secured to the bottom surface of the valve plate prevents the valve from leaking. When the receptacle containing the ice water is inserted into the water cooler housing, the hollow plug of the housing pushes the valve plate away form the valve seat to open the valve, and permit water to flow through the hole in the valve plug to the discharge valve. When the receptacle is taken out of the housing, the spring pushes the valve plate and associated rubber disk against the valve seat to close the valve again.

U.S. Pat. No. 5,431,205 issued to Gebhard teaches yet another water bottle dispensing system containing a slide valve for opening and closing the water bottle. A tubular valve body extends into the throat of the bottle. A sealing ring prevents leakage between the valve body and the bottle neck. A cup-shaped valve member is contained within the tubular valve body in inner telescoping relation. The side wall of the cup-shaped valve member is biased by a spring to physically block holes located along the side wall of the tubular valve member in order to prevent water from passing through the holes. When the bottle is inserted in its inverted condition onto the top of the water dispenser, a probe extending upwardly from the dispenser pushes the cup-shaped valve member up so that it no longer blocks the holes in the tubular valve body. In this opened position, the water contained within the bottle can flow through the holes into the interior of the tubular valve member and into the dispenser. When the bottle is removed from the dispenser, the spring returns the sliding valve to its closed position.

U.S. Pat. No. 6,325,115 issued to Cowland et al. discloses a valve assembly that is connected to the top of a bottle containing granular fertilizer. The valve consists of a ball-shaped member that is pulled by a spring against the interior end of the cap wall to close the valve. When the bottle is inverted and its cap portion is inserted into a coupling unit in the top of a receiving container, a peg on the exterior of the ball-shaped valve member engages an angled slot in the central tube of the coupling member. When the fertilizer bottle is rotated with respect to the receiving container, the peg slides along the angled slot to pull the valve member down or push it up to open or close a gap that forms between the valve member and the cap side wall. By controlling the rotational position of the fertilizer bottle with respect to the receiving container, the size of the gap can be regulated. Hence, the valve of Cowland permits a predetermined flow rate of fertilizer to be delivered to the receiving container. Because this valve regulates the flow of solid fertilizer instead of a liquid, a rubber gasket is not needed to provide a tight seal.

Other fluid dispensing devices known within the prior art include two cooperating valve members for better preventing leakage of the fluid from the storage container when it is disengaged from a lower receiving container. See, e.g., U.S. Pat. Nos. 497,896 issued to Ruppel in 1893 (gas tank); 2,401,674 issued to Vizay (gas tank); 2,989,091 issued to Lowenthal (cigarette lighter refilling apparatus); 4,874,023 issued to Ulm (water bottle dispenser); 5,694,991 issued to Harris et al. (photochemical container); 5,878,798 issued to Harris et al. (photochemical containers); and 6,539,985 issued to Shanada et al. (ink cartridge refilling apparatus). While one of the valve members is opened by means of a probe or neck of the bottle, depending upon whether the valve is positioned within the storage container or the receiving container, these devices are complicated in design and seem to require a second valve to reduce leakage. Moreover, in many cases an elastomeric seal is provided to further prevent leakage.

It would therefore be desirable to provide a simplified valve closure mechanism consisting of a single valve members for a bottle or other container associated with a fluid dispensing system, wherein the valve is automatically opened when the bottle is installed into the dispensing system, and quickly closed when the bottle is withdrawn from the dispensing system in order to substantially prevent spillage. Moreover, the valve should provide a fluid-tight seal without use of an elastomeric gasket in order to accommodate chemicals discharged by the dispensing system that are incompatible with rubber or other elastomeric materials.

SUMMARY OF THE INVENTION

A discharge valve for a bottle or other container associated with a fluid dispensing system that substantially prevents spillage of fluid composition from the container when it is withdrawn from the dispensing system is provided according to the invention. A valve body contained within the discharge valve is engaged by a hollow probe extending from the dispensing system when the container is operatively connected to the discharge system to automatically open the valve, so that the fluid composition may freely flow from the container through the discharge system to a pumping, proportioning, or mixing device that supplies the fluid composition to a desired end use application. When the container is withdrawn from the fluid dispensing system for, e.g., replacement or servicing, the probe of the dispensing system disengages the valve body, and a biasing means such as a compression spring within the valve assembly closes the valve very quickly. The valve body and valve seat of the valve assembly are designed in such a fashion that proper alignment and closure of the valve body with respect to the valve seat is achieved to provide a fluid-tight seal without use of a gasket or other elastomeric seal disposed between the valve body and valve seat to facilitate the fluid-tight seal. This preferred embodiment of the fluid disposing system is particularly beneficial for accommodating fluid compositions discharged by the dispensing system that are incompatible with rubber or other elastomeric materials. In this manner, fluid compositions may be discharged from the container in a safe, simple and environmentally compliant manner.

DETAILED DESCRIPTION OF THE PREFERRED EMBODIMENT

Figure 1:
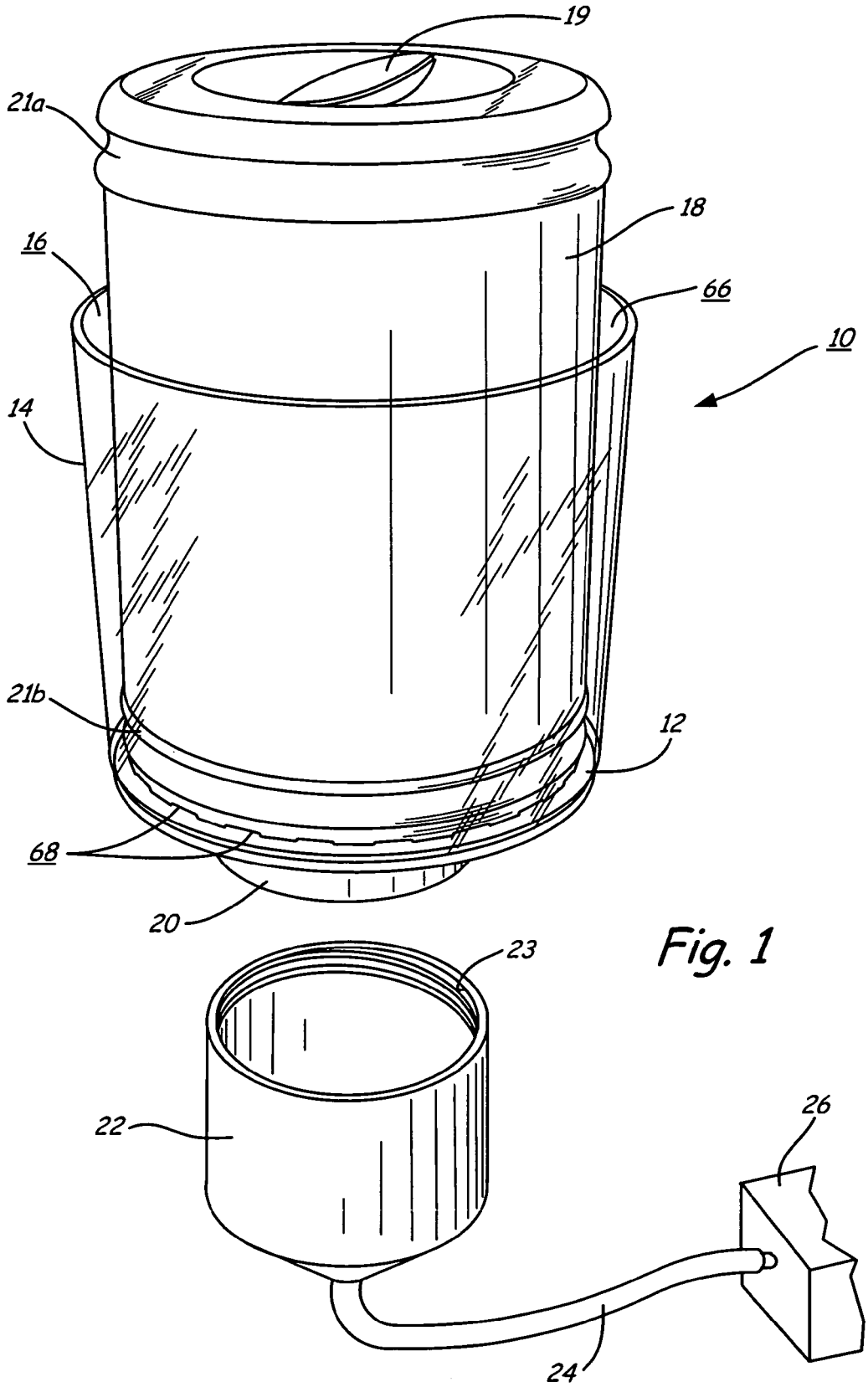
FIG. 1 is a partially exploded perspective view of the container operatively engages with the fluid dispensing system of the present invention.

A dispensing system for discharging fluid compositions in a regulated manner from an inverted storage container to a recipient device like a pumping, proportioning or mixing device in a regulated manner substantially without spillage or leakage is provided by the invention. The container contains a valve insert that is automatically opened by means of a probe extending from the dispensing system when the container is operatively connected to the dispensing system. Moreover, the valve insert automatically and promptly closes when the fully or partially filled container is withdrawn from the dispensing system for servicing or switching over in order to substantially prevent spillage. Furthermore, the valve is designed to produce line contact between the valve member and valve seat to ensure proper seating of the valve member with respect to the valve seat to substantially prevent leakage of the fluid composition from the inverted container. The fluid-tight seal is provided within the valve without use of a rubber or elastomeric gasket that might be degraded by the fluid composition. When installed, venting means contained within the dispensing system is provided to ensure that a positive pressure condition is imported into the container necessary for uninterrupted discharge of the fluid composition from the container to dispensing system, and for eliminating any vacuum condition within the bottle that would otherwise cause unwanted backflow. The valve insert may optionally include a vented membrane for relieving any pressure buildup of the fluid composition within the container when it is in its upright position.

For purposes of the present invention, "container" means, without limitation, any bottle, tote, Carboy, drum, soft pack collapsible container, or other receptacle for packaging a fluid composition. Such container is preferably a four-liter bottle for purposes of practicing this invention; however, it could be any other volumetric size that is appropriate for the particular application of the fluid dispensing system to be carried out.

In the context of the present invention, "fluid composition" means any liquid that needs to be measured, metered into, or mixed proportionately as a component with another liquid including water for use within any commercial, industrial, food processing, health, sanitation, medical, or other end-use application, or that needs to be contained from contact with human skin or other human organs, or equipment or property for the sake of safety, environmental regulatory compliance, or damage avoidance, while being used in such end-use application. Such fluid compositions may constitute, without limitation, high-alkaline, chlorinated alkaline, acidic, surfactant, solvent, oxidizer, or >corrosive compounds, and include without limitation laundry chemicals; dishware chemicals; housekeeping chemicals; cleaning compositions; vehicle cleaning chemicals; industrial water treatment chemicals; food products like juices; food additives like citrates, acids, and defoamers; additives used within the paint industry; lubricants; and medical products.

As used within this application, "elastomeric seal" means any O-ring, gasket, or other sealant made from an amorphous polymer existing above its transition temperature so that when compressed at ambient temperatures between two mating components it is readily deformed to provide a fluid-tight seal between such components. Such elastomers may constitute thermoset or thermoplastic long polymer chains cross-linked during curing, and include without limitation rubber, buna rubber, silicone RTV, Viton®, neoprene, santoprene, fluorosilicone rubber, EPDM rubber, polyurethane rubber, or nitrile rubber.

The fluid dispensing system 10 of the present invention is shown in FIG. 1. It entails a base portion 12 of a circular or other appropriate shape having a splash shield 14 extending upwardly therefrom to define a cylindrical receiving region 16 for receiving a container 18 in its inverted position. Extending downwardly from the base 12 is a collar 20 to which is secured a reservoir 22 by means of screw threaded engagement (see screw threads 23 positioned on the interior side of the reservoir 22) for receiving a fluid composition from the container 18, as will be explained more fully herein. The fluid composition in the reservoir 22 is fed by means of a delivery tube 24 to a receiver device 26.

For purposes of this invention, the receiver device 26 may constitute any piece of equipment that is suitable for pumping, proportioning, mixing, or otherwise processing the fluid composition delivered to it by the dispensing system. For example, the receiver device 26 could be a computerized dispenser that measures or meters a proportionate volume of a chemical concentrate into water or another liquid to prepare a final chemical solution. Alternatively, the receiver device 26 might constitute a manual dispenser with a proportioning tip, whereby as water or another liquid passes through the dispenser, it picks up a proportionate amount of chemical from the reservoir 22 to create the desired solution. Such receiver device 26 will normally include a pump for creating positive pressure to deliver the prepared chemical solution to an ultimate destination, such as a laundry cleaning solution for a washing machine, or a dishware cleaning solution for a dishwasher. In this manner, chemical solutions can be mixed or preconcentrates can be diluted quickly and conveniently without any need for hand measuring or hand mixing, which could result in inaccuracies or unsafe or environmentally unsound working conditions.

Figure 2:
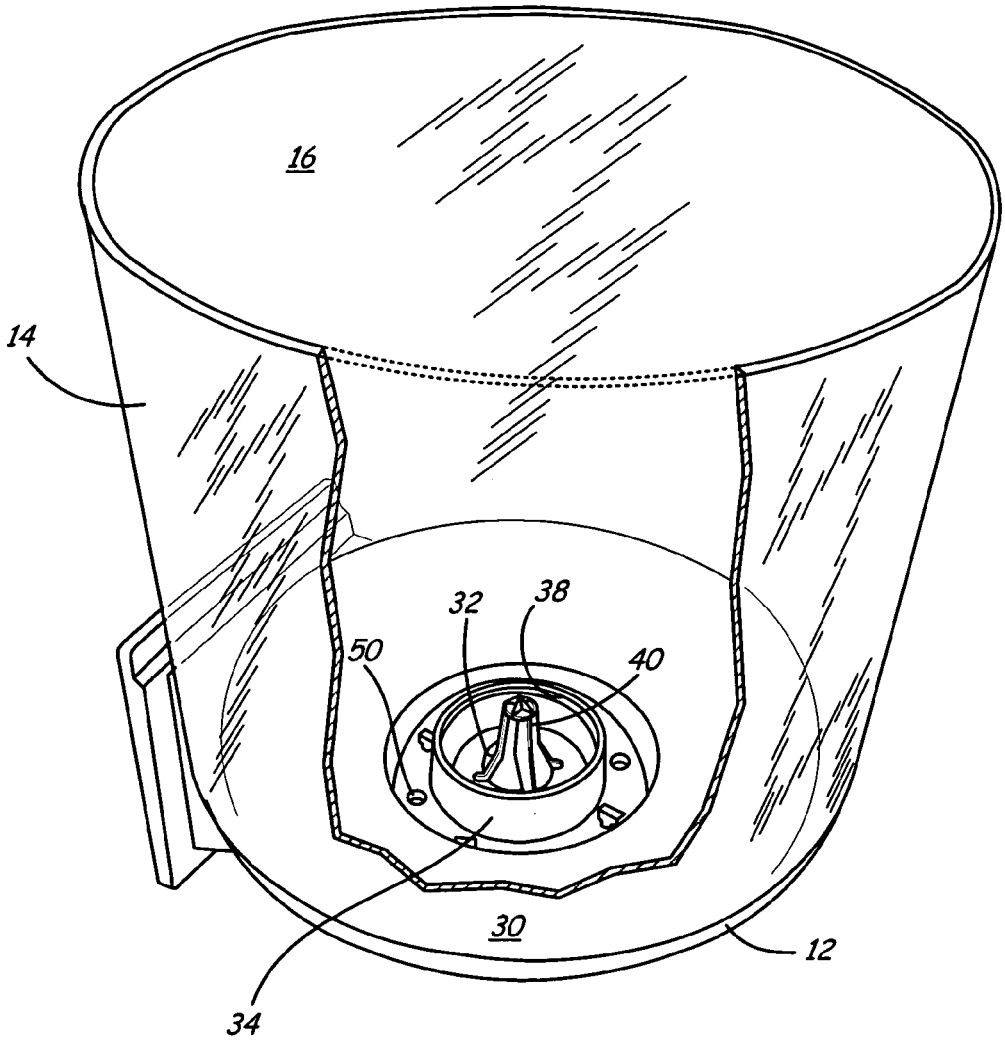
FIG. 2 is a perspective view of the dispenser base and splash shield portions of the dispensing system of FIG. 1.
Figure 3:
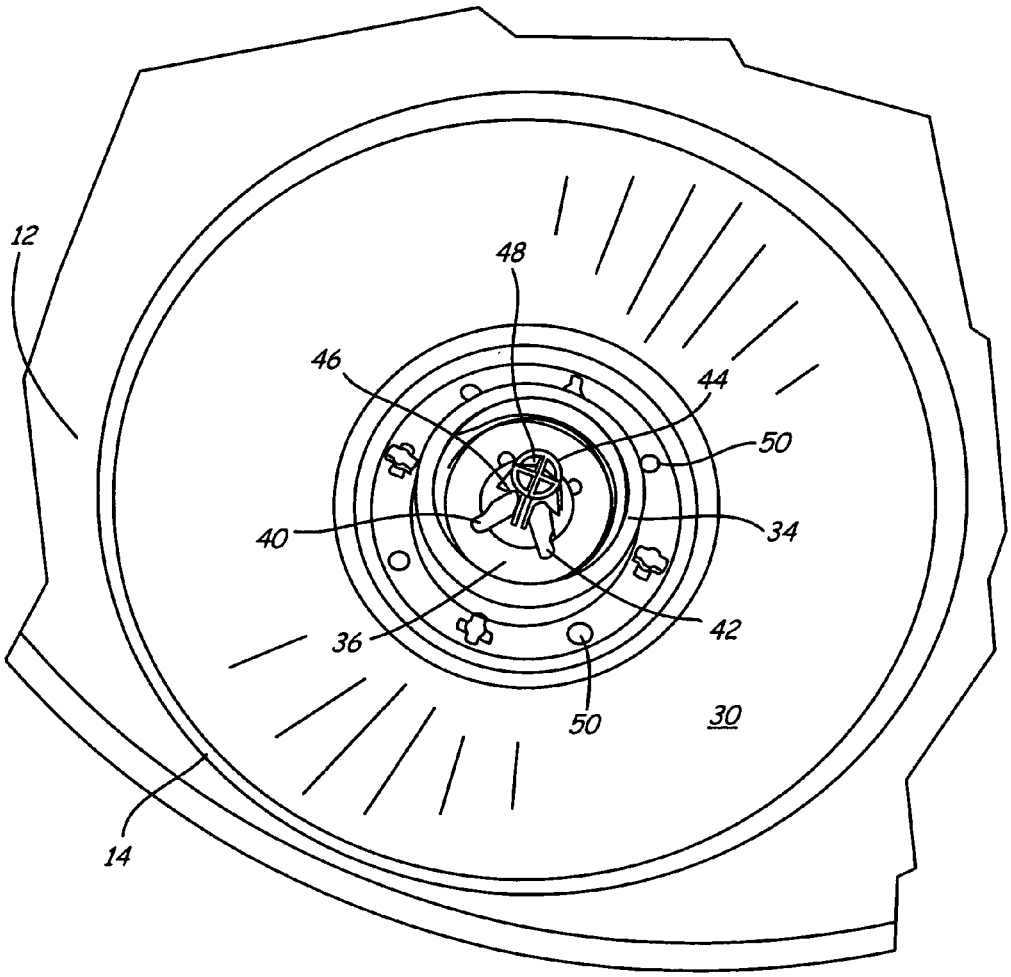
FIG. 3 is a cut-away plan view of the dispenser base and splash shield assembly of FIG. 2.

The base portion 12 of the fluid dispensing system is shown more clearly in FIG. 2-3. It includes a bottom surface 30 with the splash shield 14 extending upwardly therefrom to form the cylindrical receiving region 16 mentioned above. Located in the middle of the bottom surface 30 is an outlet port 32 through which the fluid composition can flow into the reservoir 22 below. Surrounding this outlet port 32 is upper collar 34 which extends into the cylindrical receiving region 16. The collar 34 and bottom surface 30 cooperate to from an annular region 36 for receiving the neck 60 of container 18, as will be described more fully herein. Mating threads 38 are located on the interior surface of collar 34.

Also included in base 12 is probe 40 which extends upwardly into cylindrical receiving region 16 above outlet port 32. Probe 40 is shown with a tapered sidewall 42, although this does not necessarily need to be the case. The probe 40 has a pointed, preferably pyramidal-shaped tip 44 at its distal end. The shape of this tip should ensure the desired degree of contact of the probe with the valve plunger in order to open the valve, as described more clearly herein. It should not, however, be so sharp as to pierce the valve body.

Also located within the sidewalls and tip of probe 40 are a series of apertures 46 and 48, respectively, for allowing the fluid composition to flow from container 18 into the hollow interior of the probe, so that it may readily pass through outlet port 32 into reservoir 22 positioned below base 12. Finally, positioned within bottom surface 30 around the exterior perimeter of collar 34 are a series of venting holes 50 for allowing ambient air to pass into container 18, as will be described more fully herein. The dispenser base and probe should be manufactured from a rigid plastic polymer material that does not become brittle over long exposure to chemicals, and will not shrink materially during manufacture.

Figure 4:
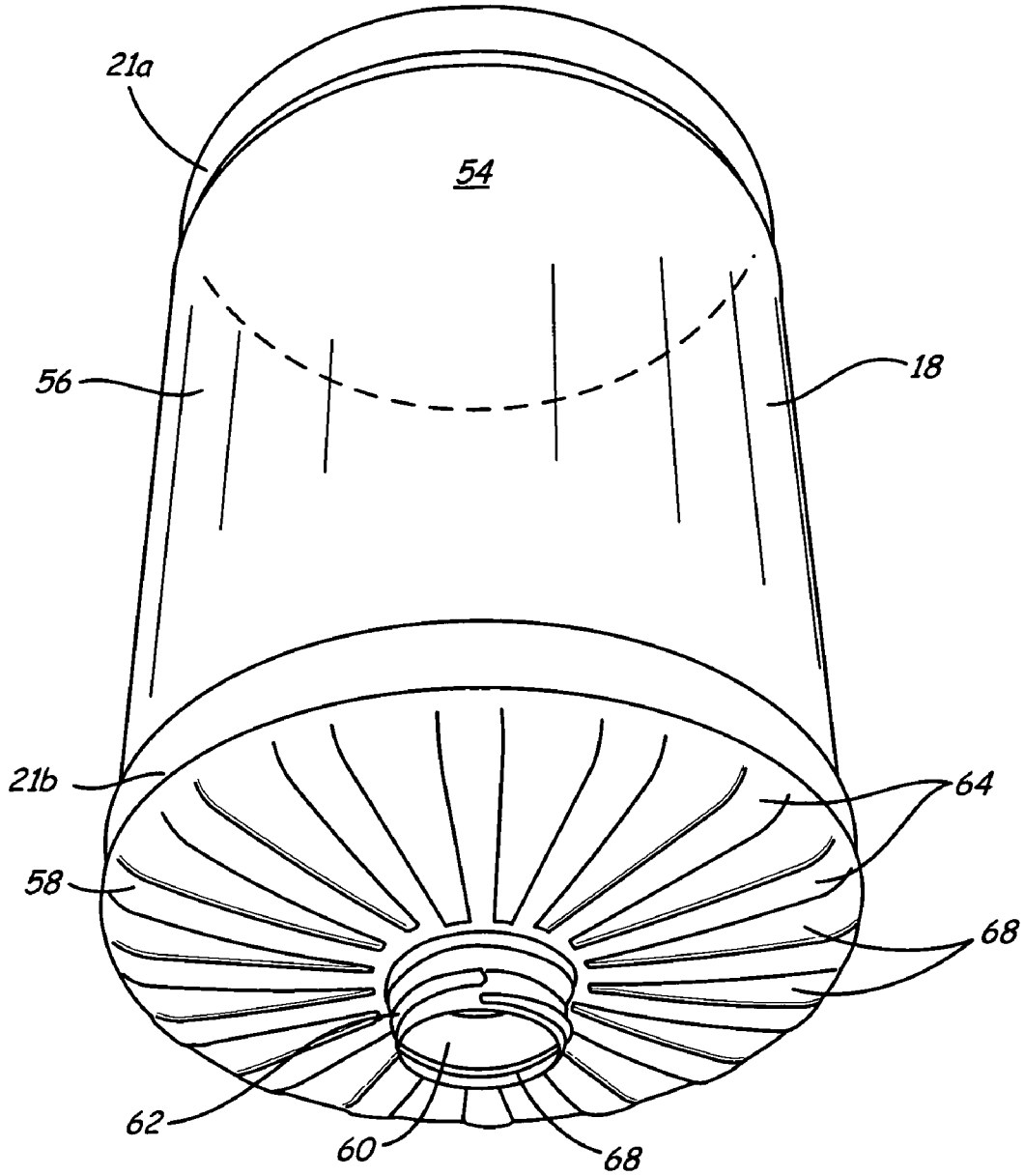
FIG. 4 is a perspective view of a container and discharge valve prior to its insertion into the container.
Figure 4:
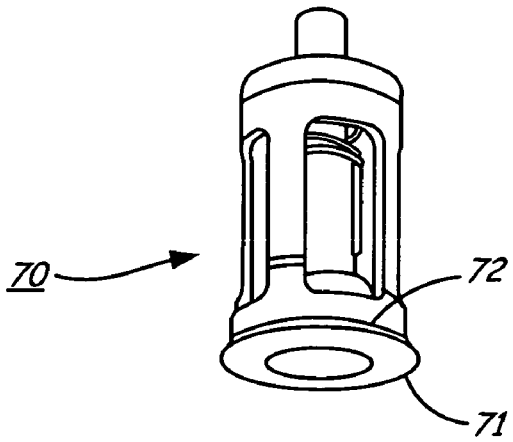

Container 18 is illustrated more clearly in FIG. 4. In this embodiment, it constitutes a 4-liter flat-top bottle which is convenient for lifting and installation into the fluid dispensing system 10. Handle 19 and grooves 21*a* and 21*b* molded within the side wall of the container can be used by a worker to assist with removal of the container from a shipping box or installation of the container in the fluid dispensing system 10. Container 18 includes a flat bottom 54 and a sidewall 56. Extending from the top of the sidewall 56 is shoulder portion 58 which terminates in a neck 60. Molded into the exterior surface of neck 60 is engagement threads 62.

In order to install container 18 in the preferred embodiment of fluid dispensing system 10, it is inverted as shown in FIGS. 1 and 4, and inserted into cylindrical receiving region 16 of base portion 12 so that the neck 60 of container 18 extends downwardly into annular region 36 of base 12. Safety shield 14 provides a visual boundary for the cylindrical receiving region 16 to assist an employee in inserting the container 18 into the fluid dispensing system. Container 18 may then be rotated in a clockwise manner so that exterior threads 62 along the container neck 60 engage the interior threads 38 of base upper collar 34. This causes container 18 to be drawn more fully down into engagement with base 12 to provide a fluid-tight seal between container 18 and the fluid dispensing system 10. It is important that the neck 60 of container 18 and upper collar 34 of the base be dimensioned appropriately to provide this fluid-tight fit and lateral support for the inverted container 18 so that it does not fall over within the cylindrical receiving region 18.

The fluid composition inside container 18 should flow directly through the outlet port 32 of the base and into reservoir 22 without passing into cylindrical receiving region 18 of the base, including the annular region 66 defined between the installed container 18 and the splash shield 14. Nevertheless, should some of the fluid composition splash into the cylindrical receiving region 16 or pass upwardly from reservoir 22 through venting holes 50 into annular region 66 due to backflow, it will be contained by splash shield 14, so that an unsafe work environment does not result.

Ribs 64 located on the exterior surface of shoulder portion 58 of container 18 cooperate with bottom surface 30 of the base 12 when the container is installed into fluid dispensing system to create air passages 68. In this manner, ambient air may pass downwardly through annular region 66, through air channels 68, and through perimeter holes 50 located along bottom surface 30 into reservoir 22. From there, the air may pass in an upwards direction through outlet port 32 into container 18. The air will form a means of positive pressure within the upper interior position of container 18 to cause the fluid composition to flow in an even manner from the container into the reservoir 22. Moreover, should a vacuum pressure condition develop within the container while fluid composition is being withdrawn through the fluid dispensing system 10 by receiving device 26, the ambient air passing into the container will defeat this vacuum pressure condition so that backflow of the fluid composition from reservoir 22 into container 18 does not result once receiving device 26 stops operation.

Container 18 will preferably be fabricated from a translucent or semi-translucent plastic material, so that the level of the fluid composition within the container is easily detectable. This will especially be true if the fluid composition is colored.

The reservoir 22 should also ideally be made from a translucent or semi-translucent plastic material, so that it is easy to visually observe the fluid composition continuously flowing into it. This confirms that the fluid dispensing system is operating properly. If an air pocket should appear within the upper portion of the reservoir, then this would suggest that the container 18 is empty, and that it needs to be replaced. The reservoir should be fabricated from a polymer material that is resistant to chemical attack without losing its clarity over time.

Reservoir 22 should also contain a sufficient volume (e.g., eight ounces) of fluid composition to continue to supply the recipient device 26, while the container is replaced. In this manner, there is no need to shut off the recipient device and operation of its associated equipment (e.g., washing machine, dishwasher) in order to service the container 18.

An important aspect of this invention is that the neck 60 of container 18 is not merely equipped with an induction seal that is pierced by the sharp edge of a probe when the container is installed in the fluid dispensing system in order to let the fluid composition flow therefrom, as is well-known within the prior art. In such a case, the fluid composition would splash from the container while it is withdrawn from the fluid dispensing system 10 in a filled or partially filled condition when the container needs to be switched with a container of another chemical or serviced. Splash shield 14 surrounding the cylindrical receiving region 16 for the container would contain only a limited amount of the fluid composition spilled while the container is withdrawn from the cylindrical receiving region 16 and inverted to its upright position. Fluid composition spilled onto the floor, work counter, or nearby equipment would inevitably result which could cause an unsafe working condition or environmental mishap on top of the loss of the valuable fluid composition. Moreover, the person servicing the container might touch the fluid composition, which could create a worker safety problem and potentially reportable incident, depending upon the nature of the fluid composition.

Instead, a discharge valve 70 is inserted into the neck region 60 of the container as shown in FIG. 4 in order to provide a positive means for regulating the outflow of fluid composition from container 18. Radial lip 71 extending laterally from the end of the discharge valve 70 abuts the distal end of neck 60 to ensure that the discharge valve does not slide too far into the container 18. The discharge valve and container neck should be proportioned such that close engagement between them is achieved to substantially prevent spillage or leakage of the fluid composition from the container. A rib 72 on the exterior of the discharge valve cooperates with a mating annular groove 74 within the interior surface of the container neck in order to reduce potential dislodgement of the discharge valve from the container.

Figure 5:
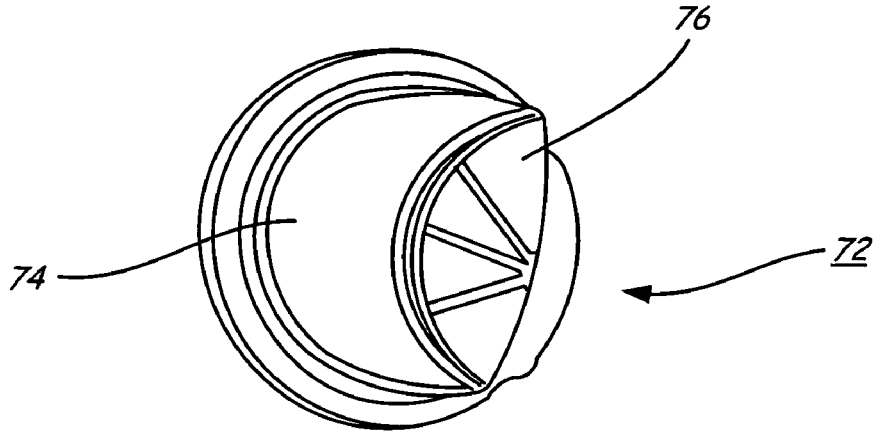
FIG. 5 is a perspective view of a duckbill valve for use as the valve body in the discharge valve assembly.

A relatively simple embodiment of discharge valve 70 is shown in FIG. 5 in the form of a duckbill valve 72, as is known within the industry. The duckbill valve includes a hollow interior surrounded by a side wall 74 and a hinged top flap 76. The duckbill valve is mounted within a housing (not shown) to provide the necessary support when it is inserted into the container neck-region 60. When container 18 is installed in its inverted position into the cylindrical receiving region 16 as described above, the tip 44 of probe 40 will push top flap 76 up to open the duckbill valve. In this manner, the fluid composition is free to flow through the valve and outlet port 32 into reservoir 22. However, when the container 18 is withdrawn from the cylindrical receiving region 16 of the fluid dispensing system 10, probe tip 44 will no longer be in contact with top flap 76 of the valve, and the resiliency of the material used to manufacture the duckbill valve 72, as well as the positive pressure applied by the fluid composition within container 18 will cause the top flap 76 to be quickly shut to close the valve. In this manner, spillage of fluid composition from container 18 may be substantially prevented. Because proper closure of the duckbill valve 72 is reliant upon the resiliency of the material used to manufacture the duckbill valve, it should be made from an appropriate elastomeric material like rubber, buna rubber, silicone RTV, Viton®, neoprene, santoprene, fluosilicone rubber, EPDM rubber, polyurethane rubber, nitrite rubber, or other material of comparable characteristics. Application of such a duckbill valve 72 embodiment to the discharge valve 70 of the fluid dispensing system 10 of the present invention will work best when the nature of the fluid composition is such that it does not degrade or otherwise damage the resiliency of the elastomeric material of the duckbill valve 72.

Figure 6:
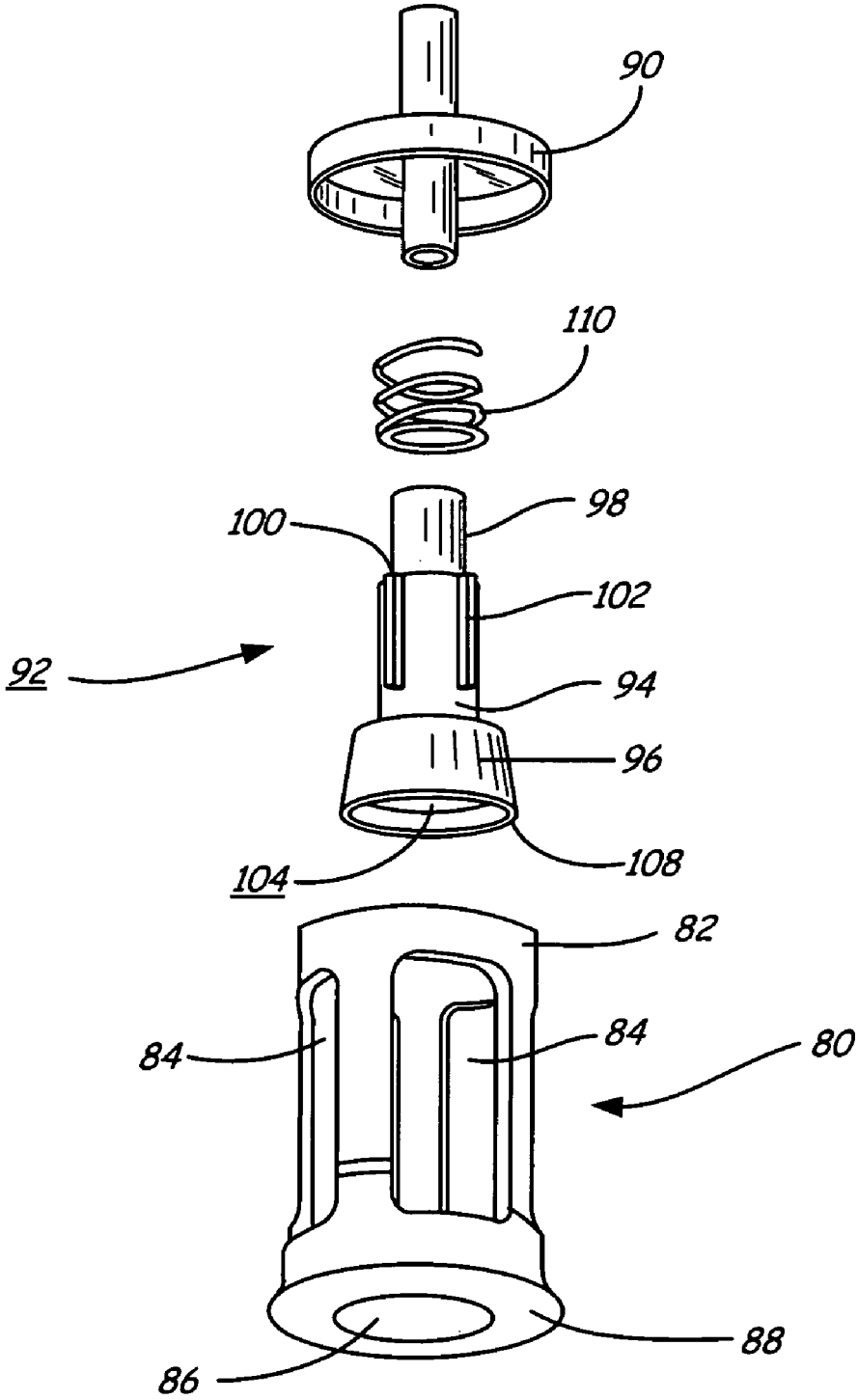
FIG. 6 is an exploded perspective view of a preferred discharge valve assembly of the present invention.

Because many fluid compositions that may be processed by the fluid dispensing system 10 of the present invention will degrade or damage elastomeric materials, a preferred embodiment of the discharge valve is shown in FIG. 6. This is a spring-biased plunger valve 80. It includes a housing 82 containing inlet ports 84 and an outlet port 86 located in the bottom wall 88. A retainer cap 90 securely fits to the top of the housing 82 to provide a containable enclosure.

Positioned within housing 82 is a plunger 92 comprising a stem portion 94 and a bell-shaped apron portion 96. A portion 98 of the stem 94 is reduced in diameter to produce a shoulder 100. Extending radially from the exterior surface of stem 94 are a series of fins 102. Meanwhile, the bell-shaped apron portion 96 of plunger 92 contains a hollow region 104. The sidewall of apron portion 96 includes a tapered surface 106 and a circumferential lip 108.

Figure 7A:
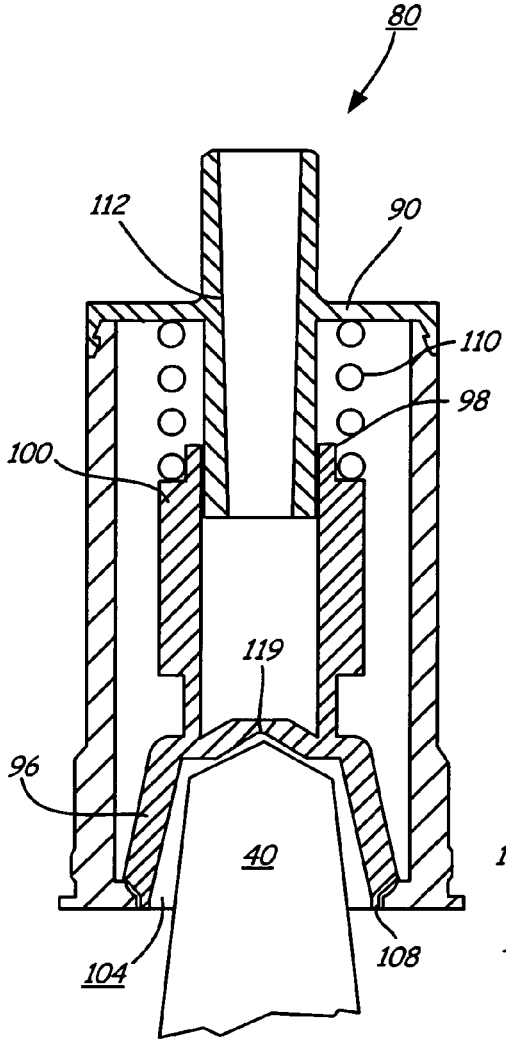
FIG. 7 is a cut-away view of the discharge valve of FIG. 6 in its open position.
Figure 7B:
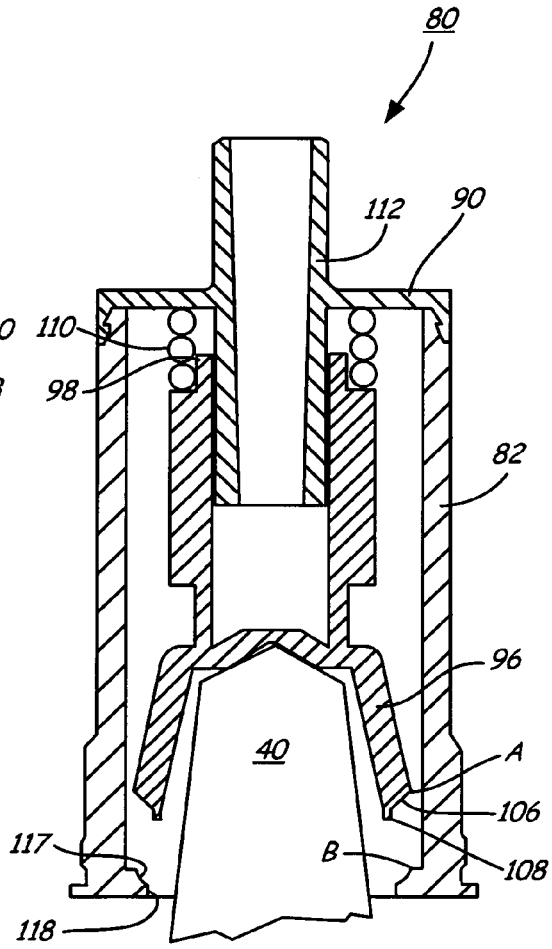

The assembled embodiment of plunger valve 80 is shown more clearly in FIGS. 7*a* and 7*b*. Shaft 112 extends downwardly from retainer cap 90 into the housing 82. The stem 94 of the plunger 92 is hollow so that it telescopes around shaft 112 for reciprocating movement of the plunger within housing 82. Stem 112 provides lateral support for the valve plunger to provide it proper longitudinal orientation with respect to valve seat 116. Meanwhile, compression spring 110 is positioned around shaft 112 between shoulder 100 and fins 102 of the valve plunger 92 and the retainer cap. In this manner, spring 110 pushes the plunger to its closed position shown in FIG. 7*a*.

A number of design features of the valve assembly cooperate for ensuring quick and successful closure of the valve body and valve seat. First, the curved contour of portion 117 of valve seat 116 on the valve housing 82 funnels the leading edge of plunger 92 in the form of lip 108 into proper centered alignment with the valve seat as the valve closes. Lip 108 on the plunger then traverses straight portion 118 of the valve seat in abutted relationship to provide final alignment of the plunger with respect to the valve seat. Second, tapered surface 106 and circumferential lip 108 of the valve plunger interact with curved portion 117 and straight portion 118 of the valve seat, respectively, to provide the liquid-tight seal. Particular attention should be devoted to this mating engagement between the valve plunger 96 and valve seat to ensure close tolerances. Third, trailing end A on plunger tapered surface 106 abuts trailing end B of the curved portion 117 of the valve seat in order to produce a line contact that will enhance this sealed and properly aligned relationship between the valve plunger and the valve seat. It is important that lip 118 not extend beyond the outside face 88 of the valve housing since use of a supplemental screw-on cap on the container during shipment would engage the lip to undesirably open the valve slightly, thereby making spillage or leakage of the fluid composition possible.

Spring 110 also needs to have sufficient compression strength in order for plunger valve 80 to close quickly when it is removed from the plunger 40. It has been found that a shorter spring measuring approximately ¾ inches long with three helical coils provides significantly greater compressive force than a spring of similar wire composition and diameter measuring approximately 1½ inches in length with 11 helical coils. A shorter spring is believed to provide a shorter throw upon release of the spring, since the spring needs to travel a shorter distance than a longer spring would. A shorter spring with fewer coils will also be less likely to be laterally deformed during compression so as to bind against the plunger shaft. Indeed, the coils of the spring should not touch shaft 112, so that there is no frictional resistance that might otherwise impede the extension of the spring 110 to its standby position when the probe 40 is removed from engagement with the valve plunger. Furthermore, a little lateral play between the plunger shaft and the guide stem of the retainer cap will allow the valve plunger to slide along the stem without resistance during valve closure. An added benefit of a shorter spring within the valve assembly is that more space will exist between the bottom of the valve plunger and the valve seat. In the case of higher-viscosity fluid compositions, more product can flow through the open valve.

In order to ensure long service life, spring 110 should be made from a passivated stainless steel material. When used with chlorinated, oxygenated, strongly acidic, or other harsh fluid compositions, Hastelloy steel widely available within the industry should be used for the spring in order to avoid corrosion or other damage.

When container 18 is installed into cylindrical receiving region 16 of the fluid dispersing system 10, probe 40 will interact with the hollow region 104 of valve plunger 92 to push the valve plunger away from valve seat 116. In this manner, the discharge valve 70 is opened, as shown in FIG. 7*b*. A depression 118 may be added to the upper wall 120 of the bell-shaped apron portion 96 of plunger 92 to interact with tip 42 of probe 40 to ensure proper orientation of the probe with respect to the valve plunger. Once the container 18 is removed from the fluid dispensing system 10 and probe 40, compression spring 110 will return the valve to its closed position shown in FIG. 7*a*.

In operation, fluid composition in container 18 will flow through inlet ports 84 of valve housing. Once the valve moves to its open position as shown in FIG. 7*b*, the fluid composition is free to flow around the valve plunger 95, through outlet port 86 of the valve housing and through outlet port 32 of the base into reservoir 22. When the valve is returned to its closed position shown in FIG. 7*a*, the fluid composition is no longer able to pass beyond the valve plunger 96 so spillage cannot occur. This is important while container 18 is being installed or uninstalled with respect to the fluid dispensing system. However, the discharge valve 70 of the present invention will also safely keep the fluid composition inside container 18 during transport or storage of the container.

Figure 8A:
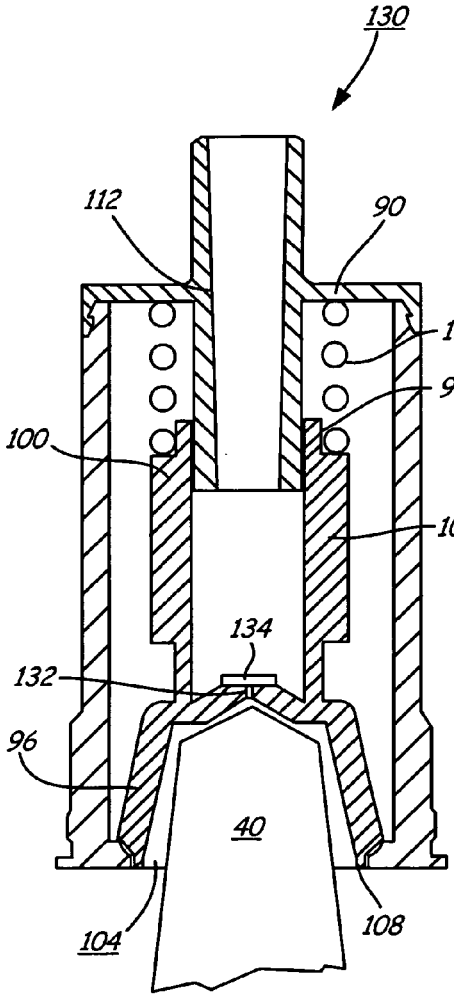
FIG. 8*a* is a cutaway view of the discharge valve of FIG. 6 additionally containing a vent hole and breathable membrane in its closed position.
Figure 8B:
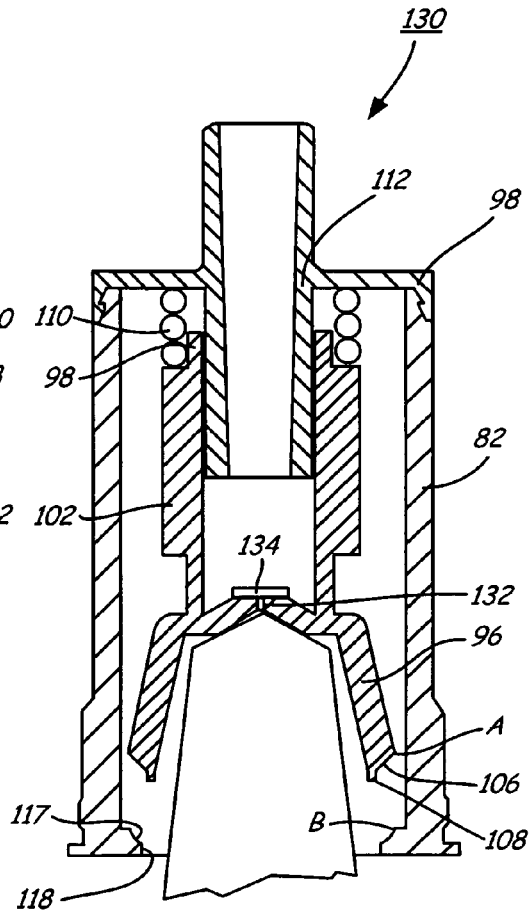
FIG. 8*b* is a cutaway view of the discharge valve of FIG. 6 additionally containing a vent hole and breathable membrane in its open position.

Another preferred embodiment of the discharge valve 130 is shown in FIGS. 8*a* and 8*b*. It is similar to the valve embodiment 80 shown in FIGS. 7*a* and 7*b*, except that upper wall 120 of the bell-shaped apron portion of the valve plunger 96 contains a vent hole 132 for allowing pressure built up within container 18 during transport or storage to escape. Secured to the interior side of upper plunger wall 120 over this vent hole 132 by means of sonic welding or other appropriate means is a breathable membrane made from a suitable material like the thermo-mechanically expanded, thin, and porous polytetrafluroethylene ("PTFE") and other fluoropolymer membrane products manufactured by W.L. Gore Corp under the Gortex® trademark. This membrane will allow air or other gasses to freely pass into or out of the container. However, it will prevent the fluid composition to pass out of the container in case the container is turned on its side or upside down. This feature prevents potential bulging or explosion of the container sealed by the closed discharge valve that could be caused by, e.g., chlorinated fluid compositions maintained under elevated temperatures, while also preventing spilling. Note that hole 132 should be smaller than the probe tip 44 in order to prevent the probe from becoming lodged within the valve plunger. Moreover, the probe tip may be shaped so that it abuts the plunger without the tip actually touching it, as shown in FIG. 8

It should also be noted that the plunger discharge valves 80 and 130 of this invention provide prompt and fluid-tight sealing performance without the presence of any elastomeric seal. This is important for fluid compositions that might otherwise degrade such an elastomeric seal.

The above specifications and drawings provide a complete description of the structure and operation of the fluid dispensing system of the present invention. However, the invention is capable of use in various other combinations, modifications, embodiments, and environments without departing from the spirit and scope of the invention. For example, the dispensing system need not be mounted to the wall for convenience, but could rest instead on a counter or floor. Likewise, it need not contain the reservoir, for the dispensing base may be directly attached to the recipient device by a tube or other delivery means. Moreover, while the invention has been described for use with four-liter bottles, larger or smaller containers could easily be substituted depending upon the usage rate by the recipient device 26 of the fluid composition contained within the container. Furthermore, instead of having the container mount directly to the dispensing system base, it could be operatively connected by means of a tube or other suitable delivery mechanism. The valve insert or probe could be mounted within the delivery tube for direct engagement with the other operative portion of the valve opening system (i.e., probe or valve insert) that is positioned on the container or dispenser base.

It is also possible to employ this invention with respect to containers that are not inverted. For example, the container could be turned on its side, which could enable the use of larger volume, heavier containers. While some of the unique benefits of the dispensing system of this invention would be surrendered, an upright container such as a 55-gallon drum could also be employed. However, in this case, the recipient device would probably need to draw a vacuum, instead of creating positive pressure by a pump, in order to withdraw the fluid composition from the upright container.

Finally, the dispensing system of the present invention can be used in association with a wide variety of fluid compositions and their end-use applications. Basically, any fluid that constitutes a component or ingredient of an end-use application, and needs to be proportionately measured and admixed with another liquid, or needs to be safely contained for environmental or worker safety reasons may be readily and advantageously processed by the fluid dispensing system of this invention. Therefore, the description of this specification and drawings are not intended to limit the invention to the particular form disclosed. Rather, the invention resides in the claims hereinafter appended.

We claim:

1. A fluid dispensing system for regulated transfer of a fluid composition to a recipient device, such dispensing system comprising:

(a) a container having upper and lower ends for containing the fluid composition, the container having a hollow neck extending upwardly from the upper end which has interior and exterior surfaces;

(b) a dispenser base having an outlet port therein;

(c) means for operatively connecting the neck of the container to the dispenser base;

(d) a hollow probe extending from the dispenser base above the outlet port, such hollow probe having at least one inlet port therein;

(e) a valve assembly inserted into the neck of the container in abutted relationship with the interior surface of the neck, the valve assembly having a valve housing with at least one inlet opening and one outlet opening, a valve body contained within the valve housing for reciprocation between a closed position wherein the valve body blocks the valve housing outlet opening to prevent passage of the fluid composition from the container, and an open position wherein the valve body is removed from the valve housing outlet opening to permit passage of the fluid composition from the container, and a spring for positively biasing the valve into its closed position;

(f) means for delivering fluid composition from the outlet port of the dispenser base to the recipient device;

(g) wherein connection of the container to the dispenser base causes the probe to engage the valve body to move it to its open position whereupon fluid composition may freely flow from the container through the dispenser base outlet port; and (h) wherein disconnection of the container from the dispenser base removes the probe from engagement with the valve body, so that the spring promptly biases the valve body to its closed position to substantially prevent spillage of fluid composition from the container without use of an elastomeric seal within the valve assembly between the valve body and the outlet opening.

2. The fluid dispensing system of claim 1 further comprising a recess within the valve body for engagement by the probe to ensure proper alignment of the probe with respect to the valve body to facilitate proper closure of the valve.

3. The fluid dispensing system of claim 1, wherein the container is connected to the dispenser base in its inverted position.

4. The fluid dispensing system of claim 1, wherein the container is connected to the dispenser base in a sideways position.

5. The fluid dispensing system of claim 1, wherein the container is connected to the dispenser base in an upright position.

6. The fluid dispensing system of claim 1, wherein the means for operatively connecting the container to the dispenser base comprises threads along the exterior surface of the neck of the container that engage mating threads along the interior surface of a collar extending from the dispenser base.

7. The fluid dispensing system of claim 1 further comprising a reservoir connected to the dispenser base below the outlet port for continuous receipt of fluid composition through the outlet port when the valve is in its open position for delivery to the recipient device upon demand.

8. The fluid dispensing system of claim 7, wherein the reservoir is made from a translucent or semi-translucent material to provide visual evidence of the fluid composition level within the reservoir.

9. The fluid dispensing system of claim 1 further comprising a safety shield extending upwardly from the dispensing base for containing any fluid composition that may spill upon or leak above the dispensing base outside of the container.

10. The fluid dispensing system of claim 1, wherein the container is selected from a group consisting of a bottle, drum, tote, Carboy, or soft pack collapsible bottle.

11. The fluid dispensing system of claim 10, wherein the container is a four-liter bottle.

12. The fluid dispensing system of claim 1 further comprising at least one venting hole positioned in the dispenser base and means for communicating air passing through the hole into the container when the valve is in its open position in order to enhance the flow of fluid composition from the container or reduce backflow.

13. The fluid dispensing system of claim 1, wherein the fluid composition is selected from the group consisting of laundry chemicals, dishware chemicals, housekeeping chemicals, cleaning chemicals, industrial water treatment chemicals, food products, food additives, additives for the paint industry, vehicle cleaning chemicals, or lubricants.

14. The fluid dispensing system of claim 1, wherein the fluid composition is a concentrate that needs to be diluted in a predetermined amount to produce a solution.

15. The fluid dispensing system of claim 1, wherein the fluid composition is one liquid component that needs to be admixed in a predetermined amount with a second liquid component.

16. A fluid dispensing system for regulated transfer of a fluid composition to a recipient device, such dispensing system comprising:

(a) a container having upper and lower ends for containing the fluid composition, the container having a hollow neck extending upwardly from the upper end which has interior and exterior surfaces;

(b) a dispenser base having an outlet port therein;

(c) means for operatively connecting the neck of the container to the dispenser base;

(d) a hollow probe extending from the dispenser base above the outlet port, such hollow probe having at least one inlet port therein;

(e) a valve assembly inserted into the neck of the container in abutted relationship with the interior surface of the neck, the valve assembly having:
  (i) a valve housing with at least one inlet opening and one outlet opening;
  (ii) a valve body contained within the valve housing comprising a shaft with a plunger extending from its one end for reciprocation between a closed position wherein the valve body blocks the valve housing outlet opening to prevent passage of the fluid composition from the container, and an open position wherein the valve body is removed from the valve housing outlet opening to permit passage of the fluid composition from the container, the plunger having a tapered edge at its one end;
  (iii) a valve seat along the valve housing outlet opening for mating with the tapered edge of the plunger;
  (iv) and means disposed around the valve body shaft between the plunger and valve housing for biasing the valve body to its closed position;
(f) means for delivering fluid composition from the outlet port of the dispenser base to the recipient device;
(g) wherein connection of the container to the dispenser base causes the probe to engage the valve plunger to move it to its open position whereupon fluid composition may freely flow from the container through the dispenser base outlet port; and
(h) wherein disconnection of the container from the dispenser base removes the probe from engagement with the valve plunger, so that the biasing means promptly moves the valve body to its closed position to substantially prevent spillage of fluid composition from the container.

17. The fluid dispensing system of claim 16, wherein at least a portion of the valve seat is of curved contour to funnel the tapered edge of the plunger towards axial alignment of the plunger with the valve seat during valve closure.

18. The fluid dispensing system of claim 17, wherein the tapered edge of the plunger abuts one end of the curved contour of the valve seat to produce line contact for enhancing the fluid-tight seal of the valve plunger against the valve seat.

19. The fluid dispensing system of claim 16 further comprising a lip extending from the plunger end for engaging with the valve seat to ensure proper alignment of the valve plunger with respect to the valve seat.

20. The fluid dispensing system of claim 16, wherein the biasing means is a compression spring, and further comprising a plurality of stops positioned on the valve shaft for supporting one end of the spring, the other end of the spring abutting the end of the valve housing opposite to the outlet opening.

21. The fluid dispensing system of claim 16 further comprising a stem extending inwardly from the end of the valve housing opposite to the outlet opening, and wherein the valve shaft is hollow, so that the valve shaft telescopes along the valve housing stem to ensure proper alignment of the valve plunger with respect to the valve seat.

22. A container for a fluid dispensing system that regulates transfer of a fluid composition inside the container to a recipient device, such container comprising:
(a) upper and lower ends and a hollow neck extending upwardly from the upper end which has interior and exterior surfaces;
(b) a valve assembly inserted into the neck of the container in abutted relationship with the interior surface of the neck, the valve assembly having a valve housing with at least one inlet opening and one outlet opening, a valve body contained within the valve housing for reciprocation between a closed position wherein the valve body blocks the valve housing outlet opening to prevent passage of the fluid composition from the container, and an open position wherein the valve body is removed from the valve housing outlet opening to permit passage of the fluid composition from the container, and a spring for positively biasing the valve into its closed position; and
(c) a hole located in the valve body permitting air passage into and out of the container for venting any pressure buildup in the container during storage or transport of the container.

23. The container of claim 22 further comprising a breathable membrane secured against the interior surface of the valve body overlaying the vent hole to prevent fluid composition from passing through the vent hole of the valve body and out of the container during storage or transport of the container.

24. The container of claim 23, wherein the breathable membrane is made from a thermo-mechanically expanded, thin, porous polytetrafluoroethylene ("PTFE") or other fluoropolymer material.

25. A fluid dispensing system for regulated transfer of a fluid composition to a recipient device, such dispensing system comprising:
(a) a container having upper and lower ends for containing the fluid composition, the container having a hollow neck extending upwardly from the upper end which has interior and exterior surfaces;
(b) a dispenser base having an outlet port therein;
(c) means for operatively connecting the container to the dispenser base;
(d) a hollow probe extending from the dispenser base above the outlet port, such hollow probe having at least one inlet port therein;
(e) a valve assembly inserted into the neck of the container in abutted relationship with the interior surface of the neck, the valve assembly having:
  (i) a valve housing with at least one inlet opening and one outlet opening;
  (ii) a valve body contained within the valve housing comprising a shaft with a plunger extending from its one end for reciprocation between a closed position wherein the valve body blocks the outlet opening, and an open position, wherein the valve body is removed from the outlet opening, the plunger having a tapered portion terminating with a downwardly oriented lip at its distal end;
  (iii) a valve seat along the outlet opening bearing a curved portion terminating with a downwardly oriented lip at its distal end;
  (iv) a compression spring for biasing the valve into its closed position;
  (v) whereby the curved portion of the valve seat funnels the lip of the plunger towards proper axial alignment of the valve plunger with the valve seat during valve closure, the lip of the valve plunger abuts the lip of the valve seat to produce final axial alignment of the valve plunger with the valve seat, and the trailing edge of the tapered portion of the plunger abuts the trailing edge of the curved portion of the valve seat to produce line contact for enhancing the fluid-tight seal between the valve plunger and the valve seat;
(f) means for delivering fluid composition from the outlet port of the dispenser base to the recipient device;
(g) wherein connection of the container to the dispenser base causes the probe to engage the valve plunger to move it to its open position whereupon fluid composition may freely flow from the container through the dispenser base outlet port; and (h) wherein disconnection of the container from the dispenser base removes the probe from engagement with the valve plunger, so that the compression spring moves the valve body to its closed position to substantially prevent spillage of fluid composition from the container.

* * * * *